United States Patent [19]

Jarlan

[11] Patent Number: 4,982,681

[45] Date of Patent: Jan. 8, 1991

[54] FLOATING MARINE STRUCTURE OF THIN DISC FORM

[75] Inventor: Gerard E. Jarlan, Versailles, France

[73] Assignee: National Research Council of Canada/Conseil National de Recherches du Canada, Ottawa, Canada

[21] Appl. No.: 268,059

[22] Filed: Nov. 7, 1988

Related U.S. Application Data

[63] Continuation of Ser. No. 147,669, Jan. 25, 1988, abandoned, which is a continuation of Ser. No. 803,295, Dec. 2, 1985, abandoned.

[30] Foreign Application Priority Data

Dec. 4, 1984 [CA] Canada ..... 469302

[51] Int. Cl.[5] ..... B63B 35/44

[52] U.S. Cl. ..... 114/264; 114/125

[58] Field of Search ..... 114/264, 83, 121, 124, 114/125, 122

[56] References Cited

U.S. PATENT DOCUMENTS

| | | | |
|---|---|---|---|
| 1,341,677 | 6/1920 | Roberts | 114/264 |
| 2,352,296 | 6/1944 | Szego | 114/83 |
| 3,299,846 | 1/1967 | Jarlan | 114/264 |

FOREIGN PATENT DOCUMENTS

| | | | |
|---|---|---|---|
| 1486572 | 9/1977 | United Kingdom | 114/264 |

*Primary Examiner*—Sherman Basinger
*Assistant Examiner*—Thomas J. Brahan
*Attorney, Agent, or Firm*—Foley & Lardner, Schwartz, Jeffery, Schwaab, Mack, Blumenthal & Evans

[57] ABSTRACT

A disc-shaped marine structure fabricated of steel and/or concrete, able to support useful loads as great as 125,000 tonnes, is tethered to float stably in very deep water, with only minor response motions to wave of large amplitude and long period. A planar base disc of diameter about 135 up to 200 meters carries a centered primary buoyancy tank of span 2.5 to 4.5 times the draft. The strongly braced sidewall of the tank is spaced about 10 meters inward of the disc edge, defining one wall of an upwardly open confinement chamber. A thin cylindric outer shell wall extending upwardly from the margin of the base has about 26% to 35% of its area comprised of tubular passages set radially, of length and diameter about one meter or more. Radial bracking frameworks of 50% aperturing interconnect the tank with the base disc and outer wall.

A mass of seawater approximately equal to the structure's displacement is largely confined, its volume/aperture ratio being about 800 $m^3/m^2$. When waves impinge the structure this mass strongly opposes accelerations by D'Alembert forces which give rise to internal pressure fields generating massive lateral flows which effect high rates of damping. As the sea rises at the shell wall a massive radial flow fills part of the chamber to a higher level, therby countering heaving force. Surge motion leads to large-scale dissipation of kinetic energy by massive inflows and outflows.

Access to seabed, e.g. for well-drilling and petroleum production, may be provided at least one vertical tube through the tank.

22 Claims, 12 Drawing Sheets

FLOATING MARINE STRUCTURE OF THIN DISC FORM

This application is a continuation of application Ser. No. 147,669, filed Jan. 25, 1988 now abandoned, which is in turn a continuation application of Ser. No. 803,295, filed Dec. 2, 1985, now abandoned.

FIELD OF THE INVENTION

This invention is in the art of marine structures intended to float in the sea carrying elevated platforms, and more particularly is directed to tethered disc-form bodies of very great diameter that have exceptional stability when impinged by ocean waves of long periods and large amplitudes.

BACKGROUND OF THE INVENTION

Heretofore, attempts have been made to reduce the response motions of a large floating body in the sea by adopting a form that couples a large mass of seawater exterior to the body so that its heaving amplitude is damped, as disclosed, for example, in U.S. Pat. No. 4,115,343 to Finsterwalder.

A cylindric body of upright axis form having an outer cylindric wall extensively perforated by transverse flow-guiding channels and having an annular chamber within the wall, with a highly apertured chamber floor, has been proposed to dissipate energy of water motion in a zone exterior to the body, for reducing wave amplitude and heave, as taught in U.S. Pat. No. 3,299,846 to G. E. Jarlan.

Other approaches to the problem have relied on locating the major buoyant volume of the body at sufficient depth to reduce heave while supporting a superstructure above the sea by slender columns, as in known semi-submersible platforms.

Still other forms dispose an air-filled chamber below mean sea level and opening downwardly so that heave compresses the air and reduces buoyancy as a function of the heaving force, as in U.S. Pat. No. 4,241,685 to G. L. Mougin.

In all prior forms so far devised it has not yet proved possible to achieve the very great load-carrying capability and the high stability desired for stationary floating structures intended, for example, to support a platform for carrying out drilling for petroleum under the seabed, and for producing and servicing a large cluster of oil and gas wells. Still greater load capacity would be required if the body could also accomodate process plants. The need to supplant semi-submersible platforms which have been relied on for supporting equipment is evident in the number of disastrous failures resulting from sea states.

A floating platform-carrying body in the open sea will be exposed to long-period, high-amplitude ocean waves and wave groups of periods 12 to 22 seconds or longer. Wave heights of such longer-period waves when at their partially breaking states may range from about 19 meters to 33 meters or more as measured from trough to crest. It will be obvious that when tethered cylindric bodies having bluff sidewalls of large area are impinged by gravity waves the relative motions of the surrounding volume of seawater will exert forces on the body. These forces arise from the flow velocities and comprise drag and inertial forces, the inertial force considerably exceeding in magnitude the drag force. A virtual mass of seawater around the obstacle is involved in the relative motion such mass being defined as that volume of fluid which experiences acceleration because of the presence of the obstacle. The virtual mass increases with the degree of wave reflection by the obstacle, and hence is a function of the form and surface porosity thereof.

The response of the obstacle to the forces will be translational accelerations, causing it to be moved through the surrounding fluid. Such motion in turn brings about a retarding drag and an opposing thrust due to inertial reaction by the invaded water mass. The relationship between the resultant force and the acceleration may be represented, for example for horizontal motion of the obstacle, simply as $F=M.a$, where the mass M is the tensor sum of a virtual inertial mass and the mass of the obstacle itself.

A body having unperforated bluff walls, loosely tethered, will sustain periodic motion, tracing large closed loops as it experiences motions pertaining to a system having three degrees of freedom, namely heave (vertical displacement), surge (horizontal sliding motion), and rolling or pitching (rotation about a horizontal axis). Floating support structures known in the prior art having shallow or moderate drafts, and diameters under 100 meters, even though provided with perforated shell walls and a partially perforated bottom, will have poor stability to large waves. If such support structure is enlarged for load-carrying capabilities adequate for well drilling, for example in sizes up 200 meters diameter, their responses to the longer-period waves would render drilling work dangerous.

Ideally, the platform from which deep sea drilling work is carried out should have a vertical displacement under wave conditions averaging about 15 meters wave height, of well under 4 meters, and pitching rotations below $\pm 4°$.

The problem of achieving reduced heave response cannot be separated in a tethered floating body from the problems of suppressing surging, rolling and pitching motions, particularly in view of the need to minimize wave reflection so that horizontal drag and inertial forces do not impose excessive loads on the anchoring system.

GENERAL OUTLINE OF THE INVENTION

It is therefore a primary purpose of the present invention to provide a large marine structure characterised by optimum surface porosity whereby net wave forces are minimized and the virtual mass is decreased, and that maximises dissipative drag, and characterized also by an internal annular chamber occupied by a very great partly confined water mass which enchances energy dissipation and lessens acceleration values.

The present invention is directed to providing novel floating structures of unprecedented load-carrying capacity and stability, which embody a concept for utilising energy of ocean waves incident on the structure to inject a mass of water through an exterior perforated shell wall into a confinement chamber of great volume, so that a part of the gravity force of the injected water mass imposes a downward load opposing heaving force, and so that the forces tending to accelerate the structure either in translation or in rotation are opposed by D'Alembert forces which are greatly augmented by the total mass of the partly-confined seawater in the chamber and wall passages.

More specifically the configuration of the structure is that of a disc of span much greater than its height, having a perforated cylindric outer wall surrounding an annular chamber closed at its bottom and closed by an inner cylindric wall spaced about 30 meters from the shell wall. Under an operating draft of about 33 meters, the volume of partly-confined seawater occupying the chamber and shell wall passages is equal to or nearly equal to the structure's displacement, in loaded condition. The inner cylindric wall of the chamber comprises the wall of a buoyancy tank centered on a planar circular base disc which, apart from a relatively small centered opening or openings giving access to the sea below, is wholly without apertures. The tank diameter at nominal draft is between about four and six times the draft.

The confinement chamber has a radial span about 30 meters, and may range from 25 to about 40 meters, which dimensions far exceed any prior chamber dimension proposed. The degree of confinement of seawater mass provided by the configuration of the chamber sidewalls and floor is such that, while seawater may move freely into and out of the chamber through a multiplicity of transverse passages extending through the outer wall, which has from about 26% to about 35% of its elevational area comprised of passage cross-sectional area, these openings comprise only about 12% of the aggregate area of the confining surfaces. Expressed otherwise, the confinement ratio may be defined as the ratio of the volume of seawater occupying the chamber to the aperture area, and is about 80 cubic meters per square meter.

The invention also contemplates a disc-shaped marine structure fabricated of steel and/or concrete, able to support useful loads as great as 125,000 tons, is tethered to float stably in very deep water, with only minor response motions to waves of large amplitude and long period. A planar base disc of diameter about 135 up to 200 meters carries a centered primary buoyancy tank of span 2.5 to 4.5 times the draft. The strongly braced sidewall of the tank is spaced about 10 meters inward of the disc edge, defining one wall of an upwardly open confinement chamber. A thin cylindric outer shell wall extending upwardly from the margin of the base has about 26% to 35% of its area comprised of tubular passages set radially, of length and diameter about one meter or more. Radial bracking frameworks of 50% aperturing interconnect the tank with the base disc and outer wall.

A mass of seawater approximately equal to the structure's displacement is largely confined, its volume/aperture ratio being about 80 $m^3/m^2$. When waves impinge the structure this mass strongly opposes accelerations by D'Alembert forces which give rise to internal pressure fields generating massive lateral flows which effect high rates of damping. As the sea rises at the shell wall a massive radial flow fills part of the chamber to a higher level, therby countering heaving force. Surge motion leads to large-scale dissipation of kinetic energy by massive inflows and outflows.

Also contemplated is a primary buoyancy tank having a ratio of overall axial height to overall diameter in the range from about 1:3 to about 1:6, an axial height of about 35 to 45 meters and said shell wall has a diameter between about 120 and 160 meters, 135 and 200 meters, 135 and 210 to 215 meters; and an extensively perforated upwardly extending outer shell wall of cylindric form and a diameter from about 3.5 or four to six times the operating draft. The marine structure's advantageously operating draft is about 30 to 35 meters with a freeboard of about 7 to 15 meters.

The buoyancy tank has a cylindric wall spaced inwardly of the shell wall and an imperforate base disc connecting the lower ends of the shell wall and the tank. The tank wall and the shell wall define together with the base disc an annular chamber which is adapted to partly confine a volume of sea water, when the structure is floating, admitted through the perforated shell wall in the range of from 80% to 125% of the displacement.

The tank wall, the chamber floor, and the outer shell wall are interconnected by equiangularly spaced radial frameworks of open construction allowing free flow between the sidewalls with minimal impedance. The ratio of framework elevational area to the area of openings is about 2:1, and preferably slightly lower.

This invention will be more particularly described and its advantages further clarified in and by the following description of its practical embodiments which is to be read in conjunction with a study of the appended drawings forming part of this specification;

DESCRIPTION OF PREFERRED EMBODIMENTS

Figure 1:
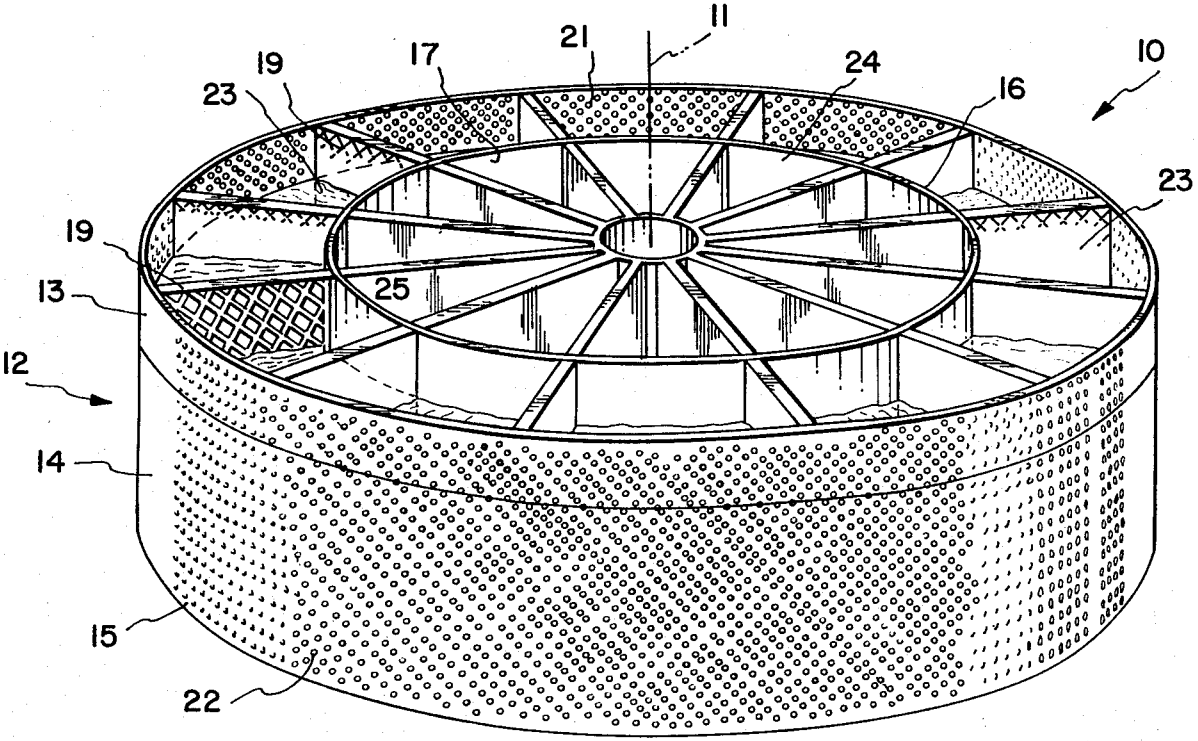
FIG. 1, a perspective aerial view of the novel marine structure, with all superstructure removed for clarity.
Figure 2:
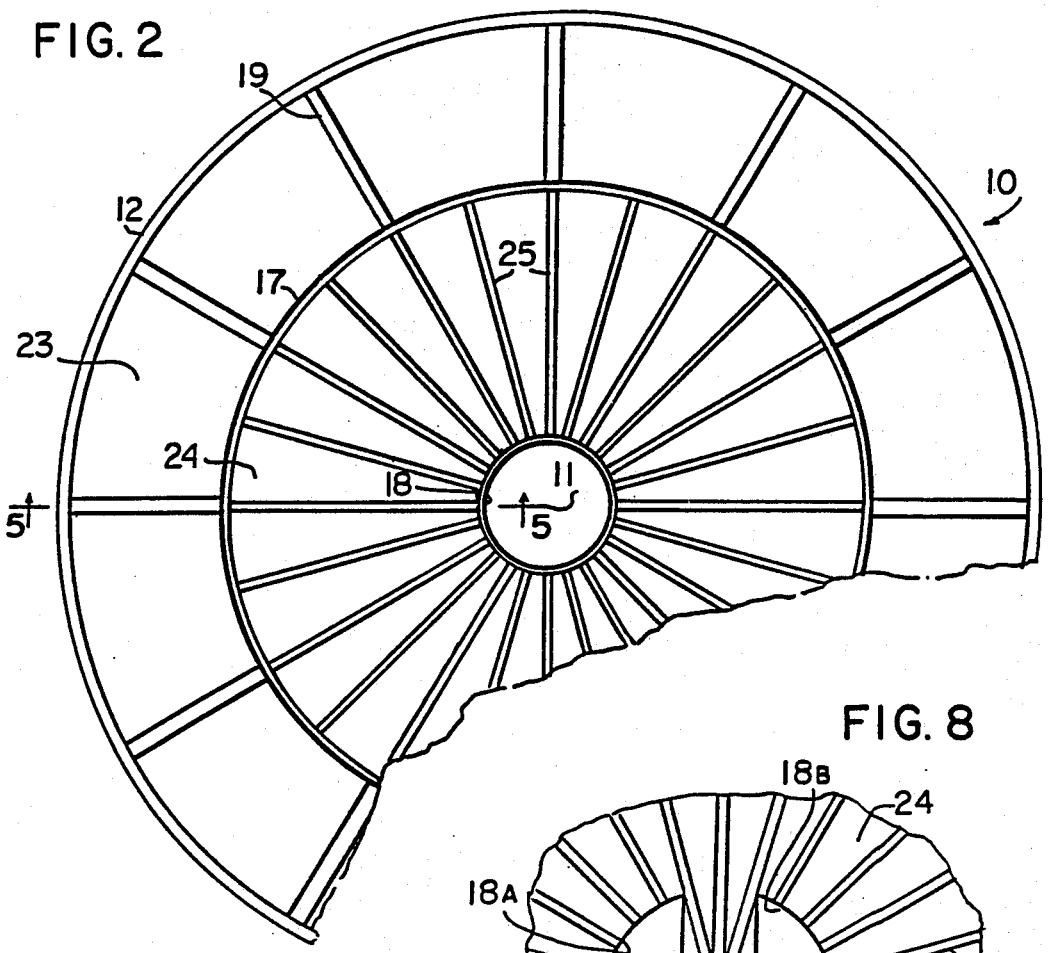
FIG. 2, a plan diagram showing proportions and bracing arrangements of the structure of FIG. 1.

Referring to FIGS. 1 through 7, a marine structure adapted to float stably in the open sea in deep water, capable of carrying great live loads comprises a body generally designated 10 of circular plan form having a vertical axis 11, partly submerged in the sea, having a cylindrical outer shell wall 12 of which a freeboard portion 13 extends some meters above mean sea level, and a major portion 14 of height 25 to 50 meters that is submerged. The structure has a diametral span greater than 100 meters, and may be fabricated in diameters ranging from about 135 meters to 210 meters or more.

Shell wall 12 rises from a planar base disc 15 of thickness suitable to the, diameter but less than about 5 meters. A marginal portion of the base is connected integrally to the lower end of the immersed portion 14 of the shell wall.

A buoyancy tank 16 concentred on the base disc has a cylindrical wall 17 spaced about 30 meters inwardly from the shell wall 12 and extends above the sea. A centred cylindrical tube wall 18 of relatively small outer diameter, for example from about 12 to 20 meters, which is coextensive with walls 122 and 17, opens through the base disc giving access to the sea below through opening 118.

Figure 8:
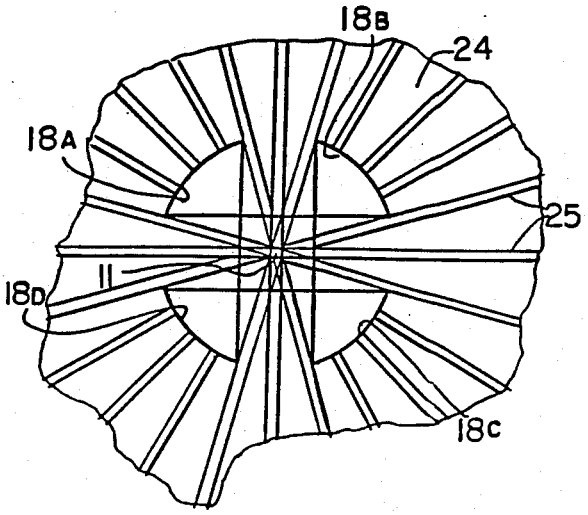
FIG. 8, a plan view of an arrangement of access tubes alternative to FIG. 2.
Figure 3:
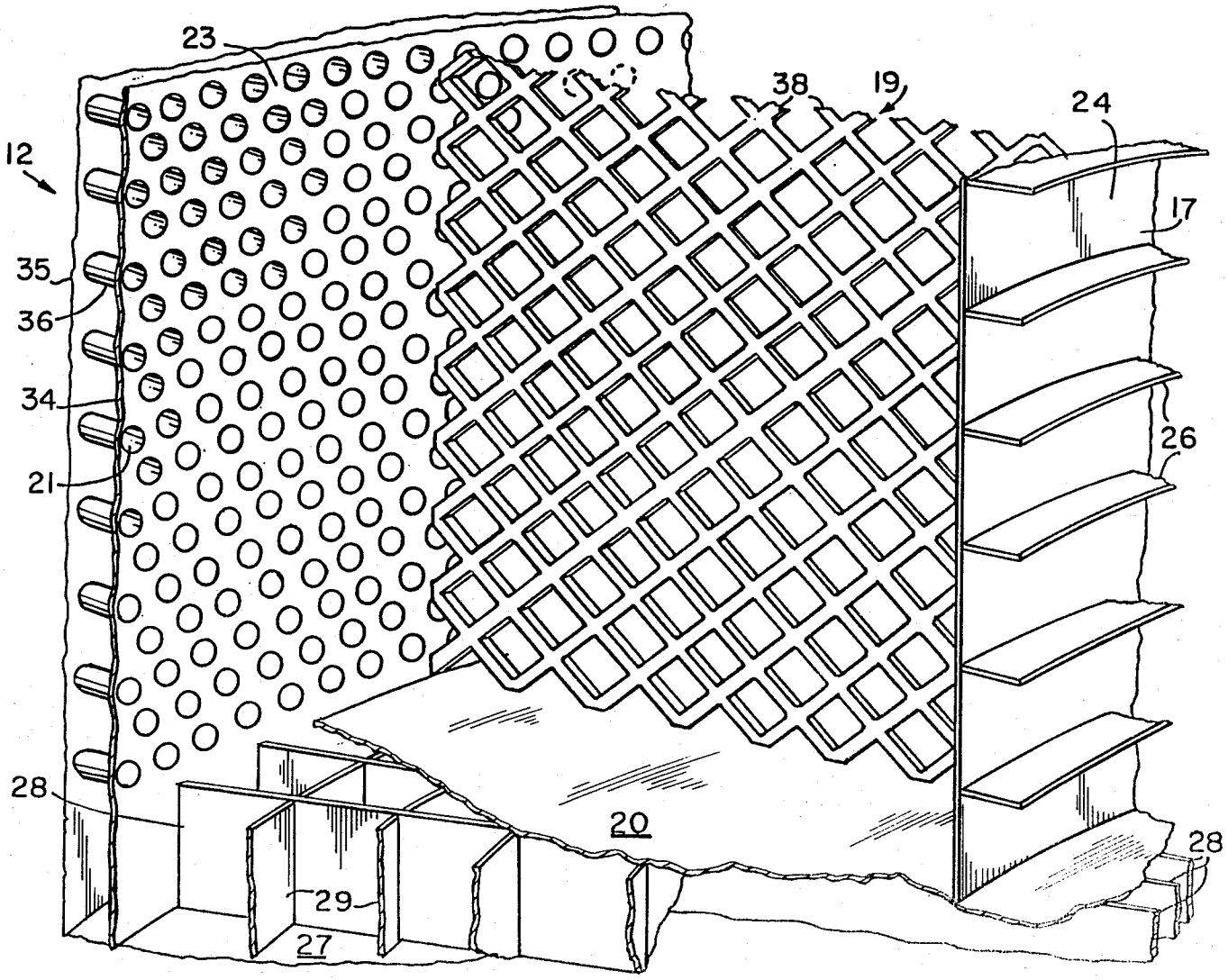
FIG. 3, a perspective enlarged view showing shell wall, base disc, tank wall, and bracing arrangements of the structure of FIG. 1.
Figure 4:
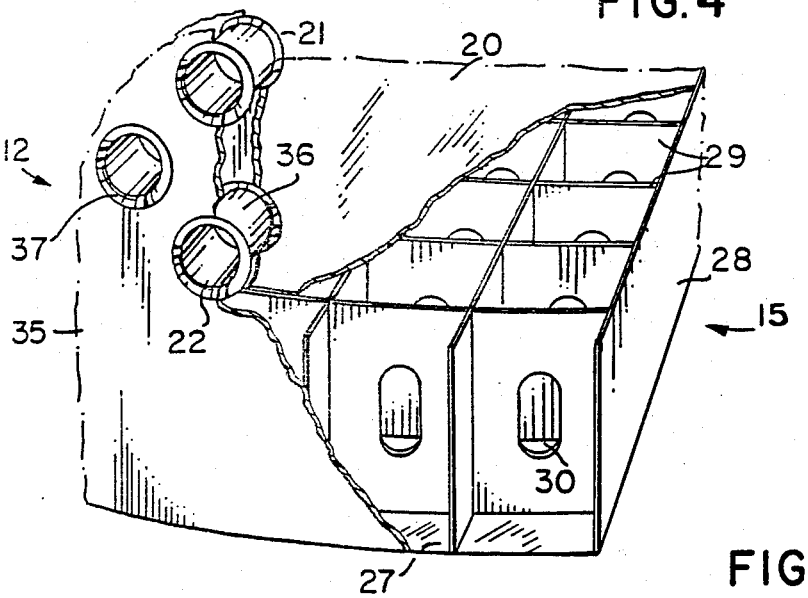
FIG. 4, a further enlarged perspective view partly cut away showing shell wall passages and base framework of FIG. 3.

The access tube 18 diameter may be increased in larger diameter structures to accommodate numbers of drill pipes, conductors and riser. Alternatively, as in FIG. 8, the structure may be pierced by a group of angularly spaced vertical access tubes 18*a*, 18*b*, 18*c* and 18*d* each of lesser transverse dimensions, e.g. 6 to 10 meters.

Shell wall 12 is connected strongly with tank wall 17 by a system of equiangularly spaced radial frameworks 19 coextensive with the walls and joined integrally at their lower ends with the upper side 20 of base disc 15. The number of such frameworks may range for example between 12 and 30 or more as necessitated by the mode of construction and diameter. Each framework 19 is of open construction, having at least about 50% or more of the elevational area comprised of transverse openings.

Shell wall 12 is extensively apertured, being provided with regularly spaced radially extending tubular passages whose inner and outer ends 21, 22 open respectively toward the tank wall and toward the sea, the passages being of diameters from about 1 to 1.2 meters and of lengths from about 1.25 to 1.5 meters and forming an aggregate cross-sectional area which is from about 26% to about 35% of the cylindrical surface area.

The space bounded by the shell wall 12 and tank wall 17 constitutes an upwardly open or partly covered confinement chamber 23, wholly closed on one vertical side by the tank, wall 17 wholly closed on its horizontal bottom by upper surface 20 of the base disc, and partly closed on the outer vertical side by the perforated shell wall 12. The volume of seawater occupying the chamber at a normal operating draft providing a water depth in the chamber of about 30 meters is very large, and is of the order of the structure's displacement when fully loaded.

The interior space 24 within the cylindrical tank wall 17 is open upwardly to any extent desired, since wall 17 rises well above the sea and is shielded from waves. A system of bracing frameworks which includes both a group of radial vertical bracing walls 25 joined to wall 17, to tube 18, and to base disc surface 20, and any desired arrangement of horizontal planar floors 26 interconnecting the cylindrical walls and radial frameworks, serves to rigidify the tank and to transfer forces both vertically and horizontally.

The structure may be fabricated in reinforced concrete or in steel. As is well known, concrete monoliths have proven advantages of durability in long-standing seabed supported marine towers. The toughness of fabricated steel structures, namely their ability to sustain peak combined stresses by non-destructive deformation, will favor their construction in diameters greater than about 120 meters. Because steel is corrosible in seawater, due care must be taken to provide suitable protective coatings and to avail of sacrificial anodes and maintenance of metal polarity to build up alkaline earth metal deposits. The invention however extends to marine structures fabricated of prestressed reinforced concrete for sites and sea conditions not developing excessive loads on anchoring points, and for diameters up to about 120 meters, which while providing excellent stability, can carry only modest loads. The following description deals with a structure manufactured of rolled steel plate and structural member Base disc 15 is comprised of an upper sheet 20 of plate and a similar lower sheet 27, of suitable thicknesses, integrally bonded to an orthogonal system of closely equiangularly spaced radial vertical beams 28 of deep webs, intersected by a series of cylindrical rings 29. The composite structure is suitably provided with access ports (FIG. 4) 30 in the ring members to facilitate construction, inspection, repair, ballasting, packing with low density impervious filling, and so forth.

The thickness and spacing of the ring members 29 is chosen to develop great strength of the base as a unitary planar body of diameter 35 to 50 times its thickness, and with regard to establishing great flexural strength along any chordal dimension parallel with the direction of propagation of waves.

Figure 5:
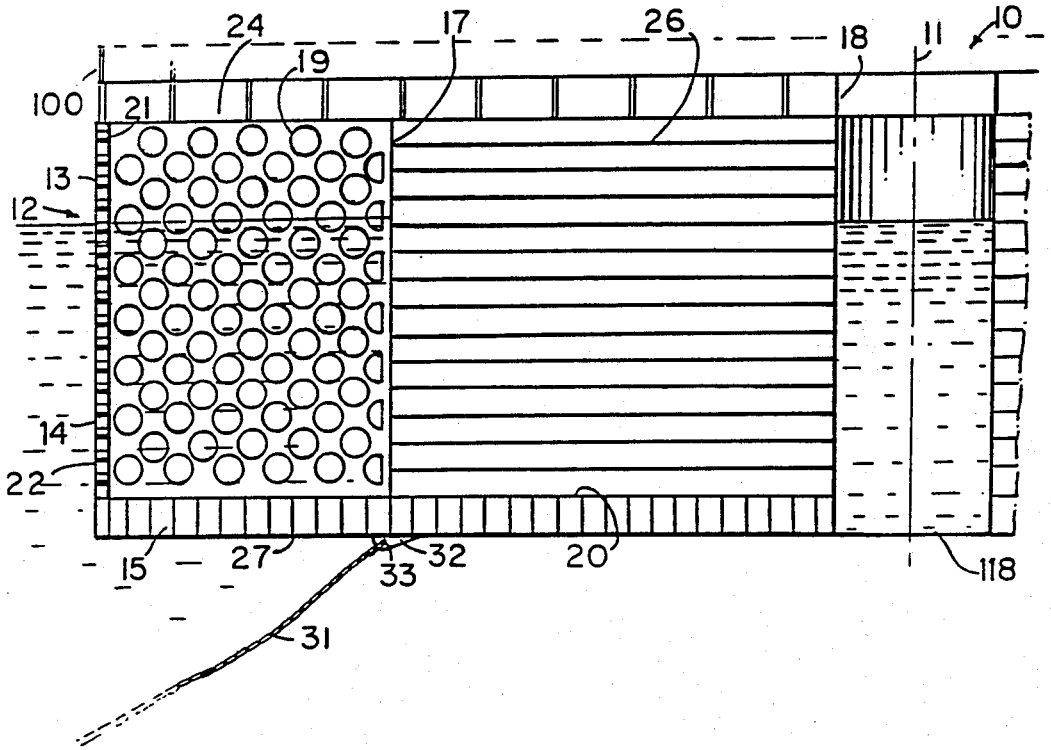
FIG. 5, an elevational view on section 5—5 of FIG. 2 showing an alternative outer wall bracing framework, and part of a tethering harness.
Figure 6:
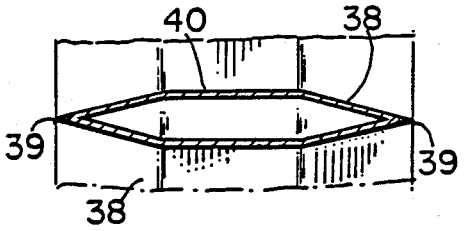
FIGS. 6 and 7, sections illustrating details of frame members alternative to that of FIG. 3.

A conventional tethering harness is intended to be connected with the floating structure after it has been towed to an intended site, such harness comprising a plurality of catenary cables or chains 31, of which one is shown in FIG. 5. The base disc framework includes a plurality of angularly-spaced integral downwardly extended connector members 32, each provided with a transverse hole 33 for engagement by an end of an associated chain or cable, whose other ends (not shown) are connected in a known manner to anchor means (not shown) in the seabed.

Shell wall 12 comprises an inner cylindrical sheet 34 and an outer cylindrical sheet 35, the sheets being spaced apart radially, for example 1.5 meters according to the chosen length of the passages. Outer sheet 35 extends to form a closing ring portion of the base disc, being integrally joined with the vertical end edges of plates 28.

The tubular passages comprise pipes 36 having their major length portion of circular cross section with smooth interior surface, and the end portions 37 of the pipes enlarging to provide openings 21, 22 and being smoothly faired to meet tangentially with the surfaces of sheets 34 and 35. The upper margin of the wall is preferably sealed by a cover and the space between the sheets is pressurized or filled by low-density material.

Any form of elevated superstructure 100 may be supported on a suitable system of columns and posts mounted above the upper ends of the shell wall, the radial frameworks, and walls 17 and 18 Moreover the interior space 24 of the tank may be subdivided into storage rooms for equipment and materials including hydrocarbons and may house process plants, living quarters, etc., as may be desired. As will be shown at a later point the total tonnage supportable by the floating structure may range to 350,000 tonnes or more, its distribution being appropriately chosen with regard to desired center of gravity of the operating structure, the tonnage including the mass of a tethering harness as referred to earlier.

Figure 7:
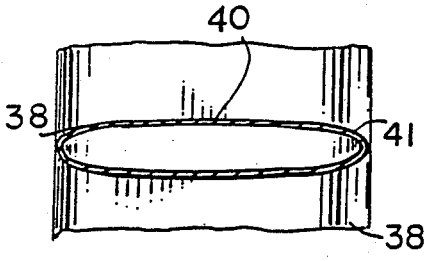

The chamber space 24 is preferably made as unobstructed as possible for optimum flow between the vertical sidewalls, and to this end the ratio of elevational area of any radial framework 19 to the cross-sectional area of the chamber should be not greater than about 2. Various rigid bracing arrangements are feasible and may comprise orthogonally intersecting tubes, beams or solid bars as in FIG. 3, or septa provided with apertures of cross-sectional area at least 5 $m^2$ of oval, elliptical or circular outlines, as shown in FIG. 5. The hydrodynamic drag of a framework can be minimized by providing fins extending laterally of a tube, beam or bar frame member, or the member may itself be shaped with oppositely extending fins. As shown in section, FIG. 6, a frame member may be a flattened tube made of sheet material with side edges 39 folded to a small radius and with a flat-sided mid-portion 40 having spaced apart walls. In FIG. 7 the member is also a flattened tube with rounded side edges 41, the member having no abrupt change of dimension likely to increase drag.

DESCRIPTION OF FACTORS AFFECTING STRUCTURE STABILITY

To ensure a clear understanding of the invention it will be useful to define heaving force as that force which a floating body experiences on its submerged hull, the integral taken over a horizontal projected area of the bottom of the pressure differences between instantaneous unit pressures and the theoretical hydrostatic pressure conditions. These pressure differences can be positive or negative producing either net upwardly-directed or net downwardly-directed forces tending respectively to lift the base or to cause it to descend.

In calculating the magnitude of heaving force it must be considered that the motions of water particles in a sea excited to wave states are greater in surface layers than in deeper layers the orbital paths decreasing in length as a function of depth to seabed and of depth below mean sea level at which motion is measured. A ratio "k" expressing orbital diameter at a depth z to that at mean sea level is defined, to the first order, as:

$$k = \frac{\text{Cosh}\,\frac{2\pi z}{L}}{\text{Cosh}\,\frac{2\pi d}{L}}$$

where "d" is the depth of water (mean sea) above seabed and "L" is the deep water wavelength.

The relationship of a structure according to the invention to large waves of long period may be understood by referring to the set of FIGS. 9 through 12 and accompanying sections 9*a* through 12*a*. In these drawings the structure is diagrammed to exclude chamber bracing and it is to be understood that the outer shell wall is extensively perforated. Dashed lines 42 herein represent the idealized horizontal plane surface of a calm sea. In the side elevation views, the solid line 43 denotes water line in the chamber around the tank, while the dot-dash line 44 represents the profile of the wave in the sea outside the structure.

Considering a floating structure according to the invention of diameter about 172 meters impinged by a wave of period 15 seconds having a deep water wavelength twice the structure diameter (351 m) it may be seen that at any moment the base will be subjected over chord-wise areas perpendicular to the direction of wave propagation, to respective upwardly-directed and downwardly-directed forces with a spacing which, for a body of rectangular plan would be equal to the length in the direction of propagation but which, for a circular plan body, is somewhat less than one diameter. The integral of all positive heave-inducing unit pressures is represented by a single vector 45 and an equal and opposite single vector 46 represents the integral of negative unit pressures. These vectors move along a body diameter at rates which vary with their position. Similar vectors may represent integrals of unit pressure for wave components of other periods, the apparent rate of travel generally correlating with the celerity of the wave which rate increases with wavelength.

The relative magnitudes of the heave-inducing force vectors are readily calculable for each wave amplitude and period by reference, for example, to the listed prior patents and to textbooks on oceanography and gravity water waves. As has been shown previously the orbit diameters of particles in a sea excited to wave activity are attenuated with depth to a greater degree for shorter-period waves than for longer-period waves. The lateral drag force per unit of wall elevational area for a given height of wave of short period may therefore be noticeably lessened at the depth of the base whereas for a 15 second wave of the same height the drag force per unit area may be about half of its mean sea level value. The heave-inducing forces exerted on the planar base will therefore be the attenuated effects solely of waves longer than about 7 seconds when the depth of the underside of the base is suitably chosen, i.e. between 25 and 50 meters, and preferably from about 33 to 38 meters.

A principal objective of this invention is to provide a floating marine structure wherein a very large confined water mass occupying an annular chamber is augmented or diminished by inflow and outflow inherently resulting from pressure fields within the chamber and in the sea outside, so that the pressure distribution over areas of the bottom of the chamber approximate the effect of distributed heaving pressures under the base.

Accordingly, the invention provides a configuration of outer shell wall and of an annular chamber so that the chamber receives and temporarily retains an injected water mass during the cresting phase of a wave so that the integral of downwardly-acting pressures matches in time and over a specific bottom area the heaving force under the base, while also discharging water mass during the troughing phase of the wave to compensate for reduced pressures under the base. The hydraulic mechanism by which the desired mass transfers are effected are discussed in the following.

INJECTION AND EJECTION OF WATER MASS

It is known that when a vertical shell wall that is perforated extensively by transverse tubular passages of low drag form is exposed on one side to a sea excited to wave activity, considerably less than half of the energy of incident waves is reflected, the greater part being converted to stream flow along the passages, impelled by the pressure gradient along the length of the passage. The transformation from potential into kinetic energy induces a horizontal transfer of an enormous mass of water through the wall at velocities which, in the near-surface layers, and depending on the head, can range from a few meters per second to 10 or more meters per second.

The head which is effective to induce flow decreases as a function of depth of the passage with respect to the sea surface unlike the phenomenon of liquid transfer through a conduit connecting two static tanks, because on the seaward side the water mass is unconfined and is in an oscillatory state characterising wave motion, and also because the water on the chamber side acquires a comparable but not completely dynamic motion as soon as transverse flow has developed. The flow velocity can, however, be substantially greater than that observed in a classical physical model of flow under the same head through a conduit connecting still volumes of water, particularly when the ends of the passage are appropriately enlarged and connected with a straight intermediate tube length by smoothly-rounded entry- and exit-guiding portions.

The flow velocity will be enhanced or diminished also as a result of wave motion in the sea according to the magnitude and orientation of the horizontal velocity component relevant to the elliptical orbital motion of water particles immediately adjacent a seaward end of the passage. Moreover, an inertia velocity head is induced through an aperture which increases the rate at which water penetrates into the chamber. This phenomenon does not occur with still volumes of water. Under a head difference of one meter, the velocity along uppermost passages as a crest of a 15 second wave of height 20 meters arrives at the wall can be 10 meters per second, assuming that the passage diameter is from 1 to 1.2 meters and the length 1.0 to 1.5 meters.

Taking into account the attenuation of effective head with depth, the volumetric rate of water transfer through a vertical cylindric segment of the wall extending, say, 44 meters below wave crest height, which height includes height gained by partial reflection, assuming 30% of the wall elevational area is comprised of passage cross-sectional area, may be about 100 cubic meters per second per meter of segment width. At a greater head, e.g. about 3 meters, the volumetric rate for the segment can be estimated at about 170 cubic meters per second. The mass injected through a wall sector of arcuate length greater than 100 meters can be estimated by summing the flows through sub-sectors according to their height and head difference. However, the water levels in the confinement chamber adjacent an injection sector greatly affect the transfer; the quantities suggested here are only illustrative of the mechanism of injection.

At a wave celerity of about 24 meters per second, the underside of the base disc may experience over strip areas extending at right angles to the direction of wave propagation, average peak pressures of about 34,000 Pascals. For waves of still longer periods the peak pressure would be greater. For any range of wave periods and amplitudes the pressure integral of positive heave-inducing force may be estimated and the position of its centroid found for any instant. In order that such pressure integral will be countervailed by a comparable and opposite downwardly acting force on the floor of the chamber, an appropriately large water mass must be injected into and held in the chamber at a level above equilibrium level for a calm sea so as to effectively maintain elevated hydrostatic pressures over the floor areas whereby to offset the upwardly-acting pressure integral. The marine structure of the present invention provides, by dimensioning the chamber radial span for effective confinement of injected water mass in proportion to the pressure integral of heave force, an effective reduction of net heaving force for the longer-period waves, and at the same time providing minimal reflection from the outer wall.

At those sectors of the shell wall where the level of the sea has fallen below the chamber water level adjacent that sector, a comparable outflow, or ejection, of water takes place. This outflow is generally influenced by the same parameters as those which control the rates of inflow, hence a massive discharge of chamber contents is produced for a given head. Consequently, whenever the heave-inducing pressure integral acting on an area of the base is decreasing, corresponding to falling height of the sea, an outflow will be initiated tending to reduce the hydrostatic pressure on the chamber floor adjacent that sector, countervailing the negative heave-inducing pressures.

STABILIZING INFLUENCES OPERATIVE IN FLOATING MARINE STRUCTURE

The structure of this invention is of hitherto unknown form, embodying a large-diameter buoyant volume within a broader thin-disc configuration, having a center of fixed mass (including operating loads above sea level and a tethering harness below the structure, and plant and equipment located below the buoyancy center)—the structure confining an annular volume of seawater having a free upper surface, of mass nearly equal to the displacement, the confined mass being bounded by a perforated vertical wall that is open to the sea via tubular radial passages.

The degree of confinement is such that only about 12% to 15% of the internal surface area wetted by the confined mass comprises cross-sectional area of passages. This cross-sectional area comprises about 26% to 35% of the elevational area of the cylindric outer wall. No openings whatsoever exist in the floor of the chamber, so that inflow and outflow of water between the chamber and the sea is directed horizontally at all times.

The multiplicity of passages serves as highly efficient hydraulic mechanism for transforming a pressure field characterising wave motion in the sea into mass transport of seawater through the wall and for reducing the virtual mass pertaining to the oscillatory wave motion. Such radial flow promotes fine-pattern turbulence that inherently rapidly degrades kinetic energy into heat, for both inflow and outflow.

Unlike seabed supported prior art structures of tower form, also provided with a perforated outer shell wall and an annular chamber having a closed bottom, a floating structure inherently presents problems of achieving minimal motion in response to waves of long periods and large amplitudes; since it has three principal degrees of freedom, impulses received from the wave field can set up any combination of up-down motion, rotation about a vertical axis, or horizontal sliding. Of these possible motions the most important stability requirements require minimal heaving, pitching or rolling, and surge. Swaying and yawing are of considerably lesser importance.

Unlike a free-floating cylindric body for which the parameters of metacenter, metacentric radius, and metacentric height can be accurately calculated from body geometry, the roll response of the structure of the present invention when inclined in still water is strongly attenuated by the perforated wall surrounding and confining a great volume of seawater in the annular chamber, and the righting couple is affected by delayed shift of the buoyancy center and by an acceleration-dependent shift of the center of gravity.

As the structure is progressively inclined, it will be seen that as one sectoral portion begins to rise an opposite sectoral portion sinks, or stated otherwise, the structure is angularly accelerated from rest to a finite angular velocity about a transverse diameter. The chamber floor exerts a force on the confined water volume in the sector that is starting to rise, thereby setting up an auxiliary pressure field, the magnitude of which depends on the rate of increase of angular velocity imparted to the mass above the floor, i.e. on the acceleration. It is to be understood that such acceleration-induced pressure field exists solely as a function of change of velocity of the structure whereas the hydrostatic pressure distribution normally existing in a body of still water is a function of depth below sea surface and does not disappear at zero acceleration.

Because one sidewall of the chamber is partly apertured, the auxiliary pressure field produces an outflow of water through the shell wall and also causes a lateral flow along the two arcuate channels formed by chamber portions adjacent the rising sector. These flows may be augmented by hydrostatic pressure gradients which may develop along the radial passages by reason of elevation of any part of the confined water mass above the sea. At the same time the mass of seawater occupying the sectoral zone of the chamber which is starting to sink, that is which is being accelerated from resting state to a finite angular velocity, will experience a negative auxiliary pressure field, setting up lateral inflows, which are augmented by any lowering of hydrostatic pressure head in radial passages as inclination lowers the chamber level below the sea.

The induced lateral flows transport a great volume of water in unit time, and manifest the conversion of lifting work done by the structure into rapidly degrading kinetic energy, whereas the angular velocity acquired by the structure itself represents stored or potential energy that enters into oscillatory phenomena, i.e. rolling. The flows persist after angular acceleration has ceased as long as angular velocity remains, tending to further elevate the confined mass. It will be evident that where the confined mass is large, for example of the order of the structure's displacement, it is highly effective to oppose inclination and to dissipate energy of rotation.

It may be seen that the development of the immersed and emerged wedges characterising inclination of a cylindrical tank, whereby the center of buoyancy shifts laterally in the direction of inclination as new water lines are established around the tank, is considerably delayed in the novel marine structure, until the waterlines have adjusted to the level of the sea outside. The effect is that the classical righting couple due to positive and negative buoyancy wedges does not come into existence promptly and increase directly with inclination, but may be delayed several seconds, and may even be increasing at a time when inclination is decreasing.

Although the buoyancy-derived righting couple may be ineffective initially, there is a strong couple produced by the apparent shift in the center of gravity of the composite mass in the direction opposite to the inclination, as the response of the mass to acceleration, which couple has no counterpart in known marine structures.

When the inclined structure is released, the righting rotation is strongly opposed by the D'Alembert forces representing the inertia of the confined mass and of the structure itself, and the high rate of degradation of energies of motion as has been shown hereinabove again prevails, so that rolling oscillation is greatly attenuated.

STABILIZATION - ROTATION ABOUT A DIAMETER

When an eccentric force or a pair of vertical thrust forces acting as a couple is or are directed on the base disc, the structure will gradually take on an angular velocity as the accelerating couple persists. The significant contributions of resistance to the rotational motion arise from:

(a) motion imparted by the moving structure to an adjacent mass of seawater, i.e. water in the free sea occupying a region under the base, constituting a wholly unconfined mass of uncertain magnitude, approximately equal to the displacement; the centers of resistance are approximately located at the centroids of the base area in respect of a diameter;

(b) the inertia of the structure itself opposes acceleration; that is, the 'dry' mass including ballasting and all loads, has a moment of inertia acting at a distance from a diameter equal to the radius of gyration;

(c) the opposition to acceleration of the confined mass of seawater occupying the annular chamber, which mass has a free upper surface and magnitude of the order of the structure's displacement; the location of the counter-force is roughly at about a half radius distance from a diameter;

(d) a righting couple tending to bring the structure axis back to the vertical begins to be effective as immersed and emerged wedges take shape around the buoyancy tank;

(e) the increase in tension of anchoring links at the raised side of the base and a decrease in tension of links on the opposite side of the structure's axis provide a further righting couple.

STABILIZATION - HEAVING

Up-down movement of the structure is resisted analagously to its opposition to rotation:

(a) the underside of the base disc imparts motion to the adjacent volume of the free sea, the effective coupled mass being somewhat greater than the displacement;

(b) the counterforce arising from vertical acceleration of the structure acts along the axis;

(c) the acceleration of the confined water mass in the chamber imposes a D'Alembert force opposing the acceleration; since there is no pressure gradient circumferentially, energy is dissipated by ejection or inflow of water through the shell wall;

(d) the decrease of buoyancy due to emergence of a greater part of the tank volume when the structure is lifted by heave, contributes a downward force opposing the heave;

(e) increase in tension of all tethering links opposes heave.

STABILIZATION - SURGE

Sliding of the structure in the direction of the plane of the base is resisted by energy-dissipative phenomena which are attended by horizontal counter-forces:

(a) when the virtual mass represented by volumes of the free sea surface in sectoral zones contiguous to the shell wall amounting to about 0.2 to 0.3 times the displacement, is invaded by movement of the structure into a zone, a drag force arises, along the direction of motion; a small head is created between ends of tubular passages, effecting a large mass transport through sectors of the shell wall;

(c) the interchange of seawater with the confined chamber mass stated for a) is affected by the opposition to acceleration of the water mass in a horizontal direction, notably by the development of pressure directed against a sectoral zone of the buoyancy tank wall which is being accelerated; consequently the bow sector of the shell wall passes a large volume of seawater through the tubular passages of that sector, the water streaming into the chamber branching as flows along sectors at the sides and stern; a large outflow through the sides minimises rise of chamber water level, while the slight velocity increase of water discharged through the outer wall in the stern sector promotes turbulence in the sea, abating the wave thrust which is causing surge; the terms 'bow' and 'stern' here relate to the apparent roles based on direction of movement that is, the 'bow' is on the other side to that against which the driving force is exerted;

(e) the tethering harness acts as springs, with tension increase proportional to translatory motion.

In addition to the resisting counterforces and drag loads discussed above, a significant enhancement of stabilisation by a well-designed arrangement of tethering links, such as catenary cables or chains connected under the base and extending to anchors in the seabed, can be expected to limit heaving, pitching and surging responses. Nevertheless, the inherent stability of a structure to minimise these motions solely by choices of its dimensions and configuration is a fundamental necessity since a tethering harness of acceptable cost cannot correct excessive responses.

MODEL STUDIES

Referring to FIGS. 16, 17, 18 and 19, a 1:100 scale model has been built and tested in a wave tank, the most severe sea state being simulated by wave trains produced from a driving signal representative of actual storm conditions. With the wave spectrum employed, of the JONSWAP type, wave groups are also generated with various grouping factors. Moreover, wave drift of forms having long periods—of the order of 120 to 300 seconds - arising from the frequency difference in the wave components are of concern and necessitate very long testing intervals to reveal their effect. The waves as actually generated were analysed by detectors just ahead of the tethered model, and amplitude trace 47 of FIG. 16 was recorded. Analysis of the recorded data yielded the following particulars:

| | |
|---|---|
| Characteristic wave height | 15.24 meters |
| average of the highest one-third wave heights or significant wave height, by zero crossing analysis | 15.71 meters |
| maximum wave height | 26.57 meters |
| peak wave period | 15.52 secs. |
| peak wave period by Delft method | 15.53 meters |
| average wave period by zero crossing analysis | 13.82 meters |
| groupiness factor | 0.81 meters |

Figure 17:
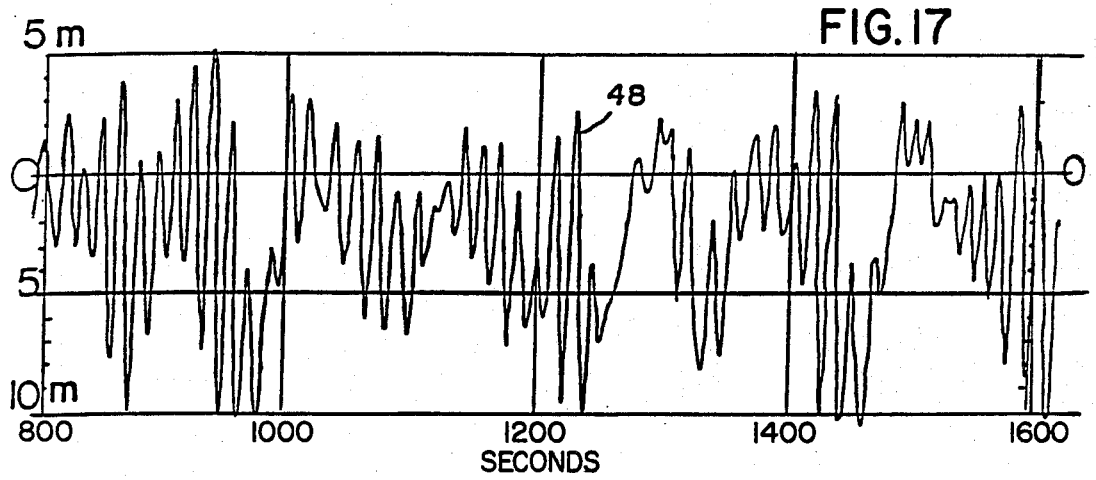
FIG. 17, a trace of surge response to the waves of FIG. 16
Figure 18:
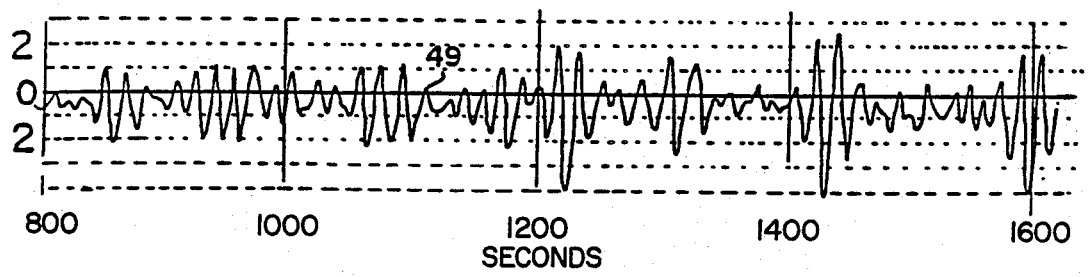
FIG. 18, a trace of heave response of the structure.
Figure 16:
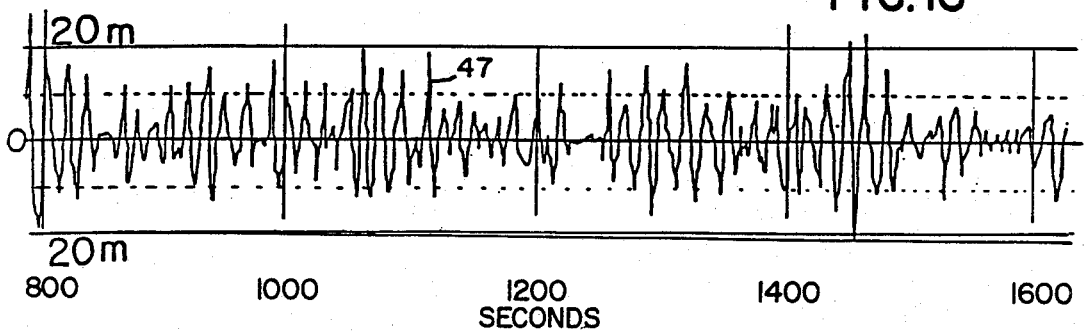
FIG. 16, a trace of amplitudes of impinging JONSWAP type spectrum waves on a 1:100 scale model of the structure of FIG. 1.
Figure 19:
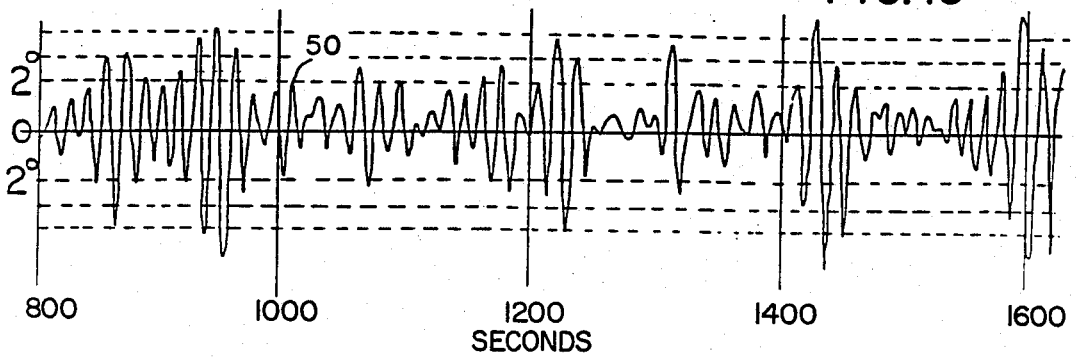
FIG. 19, a trace of pitching or rolling response of the structure.

The traces 48, 49 and 50 of FIGS. 17, 18, and 19 represent excursions of position of the tested structure from resting state in still water, respectively denoting surge and heave, in meters, and pitch in degrees of rotation, throughout an extended time interval. A significant time portion, viz. 800 seconds, represented by the traces shown.

The vertical motion, trace 49, is obviously remarkably small and confirms the utility of such marine structure for use as a platform.

Figure 13:
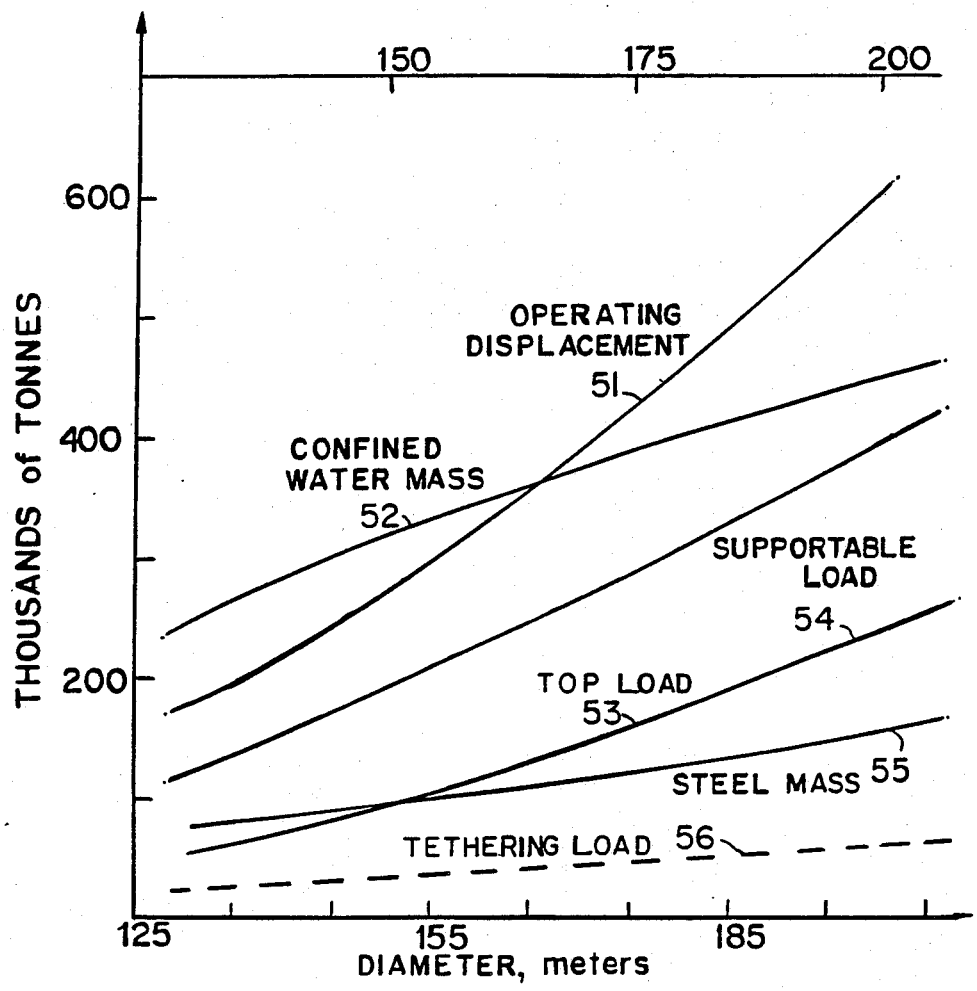
FIG. 13, a graph relating design parameters for a range of diameters of the structure when fabricated of steel with constant draft and constant chamber radius.

The invention may be practiced in the construction of floatable platforms of a wide range of diameters and drafts, the load-support capability increasing non-linearly with increase of radius, as may be seen from FIG. 13. The displacement of a steel structure under load, curve 51, increases more rapidly with diameter than the volume of the confined water mass, curve 52, these quantities being within about 80% to 125% of each other. An allowable value of top load, curve 53, is found from the supportable load—curve 54—which is the net quantity remaining after subtracting from 51 the structure mass—curve 55—and the tethering load, curve 56. Depending on the desired position of the structure's center of gravity, curve 53 may be larger than half the mass indicated as total supportable load.

In any event, the capability of an example structure of diameter about 172 meters and draft 33 meters with base thickness 4 meters and chamber radius 30 meters, is a gross load at least 250,000 tonnes, of which about 125,000 tonnes or more may be top load. These loads far exceed loads presently installed on very large seabed-supported marine towers and are much greater than the loads supported by semi-submersible platforms which are usually top-heavy.

Figure 14:
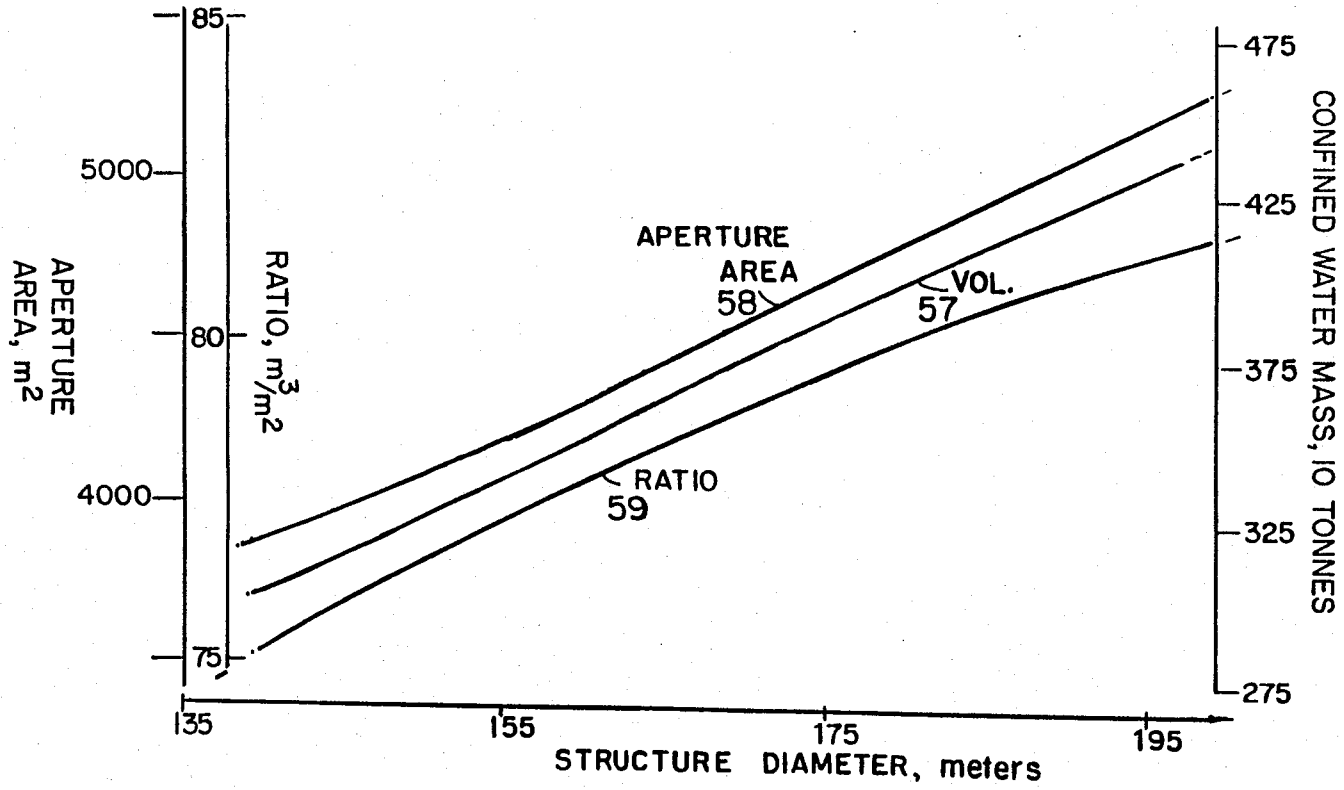
FIG. 14, a graph showing relationship of confined water volume and openness of the chamber sidewall for a range of diameters.

In FIG. 14, certain parameters are shown for marine structures having a confined water mass, namely curve 57 relates the mass to body diameter while curve 58 shows aperture area of the immersed part of the shell wall in relation to diameter. Curve 59 is a ratio expressing the degree of confinement of chamber water, numerically equal to the cubic meters of volume divided by the square meters of wall aperture area.

Figure 15:
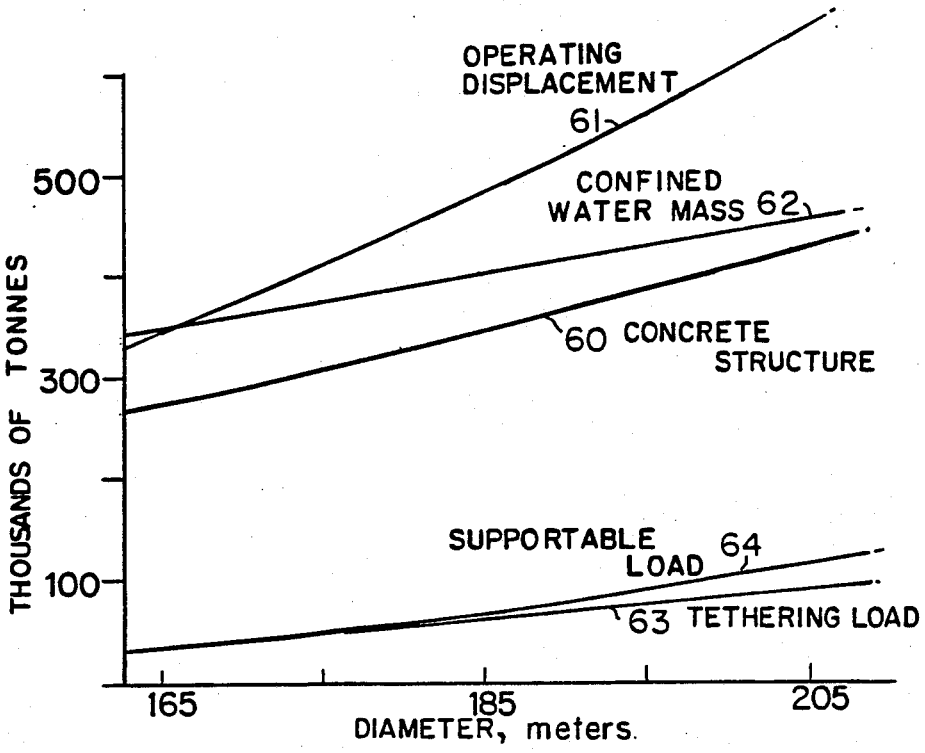
FIG. 15, a graph showing data similar to FIG. 13 for the marine structure when fabricated of reinforced concrete.
Figure 9:
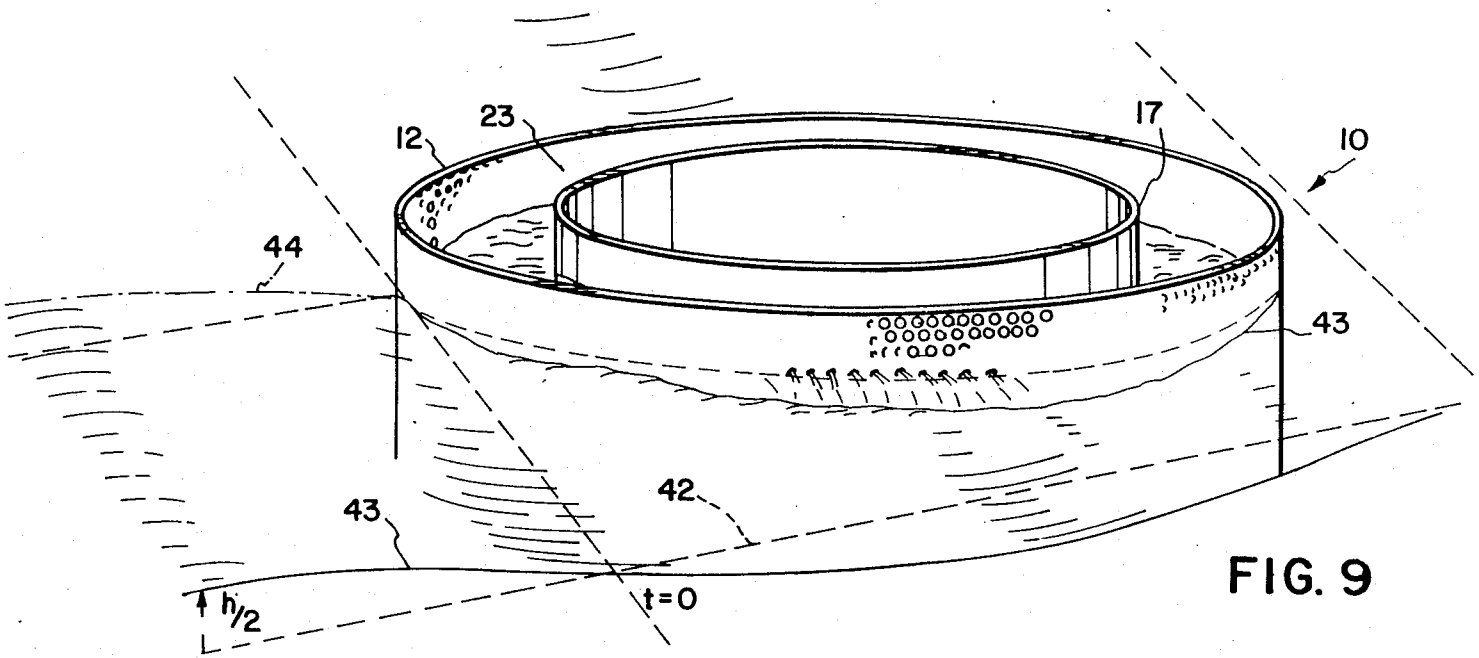
FIGS. 9, 10, 11, 12, aerial perspective views illustrating relationship of the floating structure of FIG. 1 to an idealised wave.
Figure 9A:
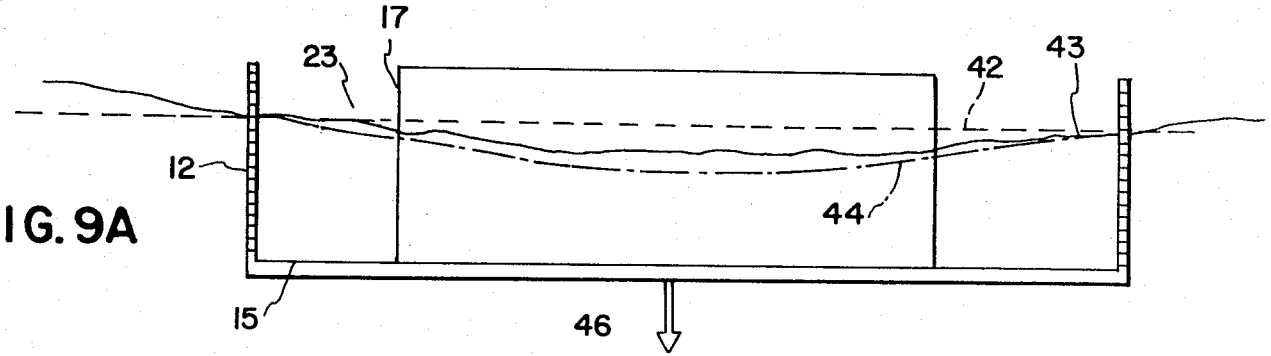
FIGS. 9*a*, 10*a*, 11*a*, and 12*a*, side elevation views in diametral section of the respective wave and structure states of FIGS. 9–12.
Figure 10:
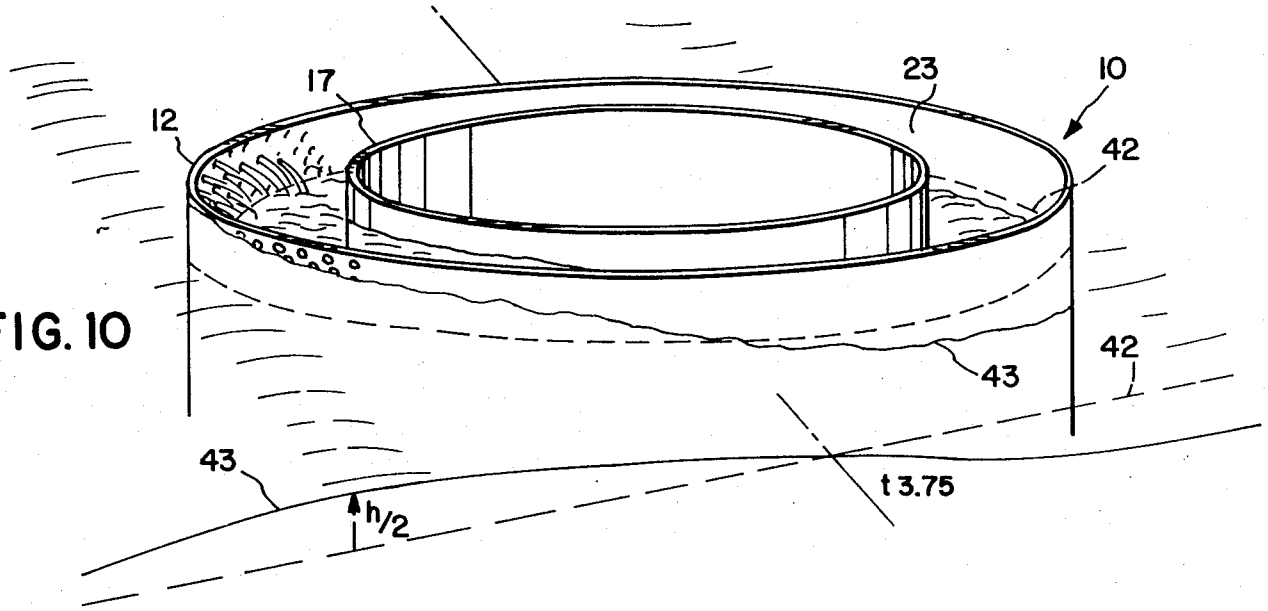
Figure 10A:
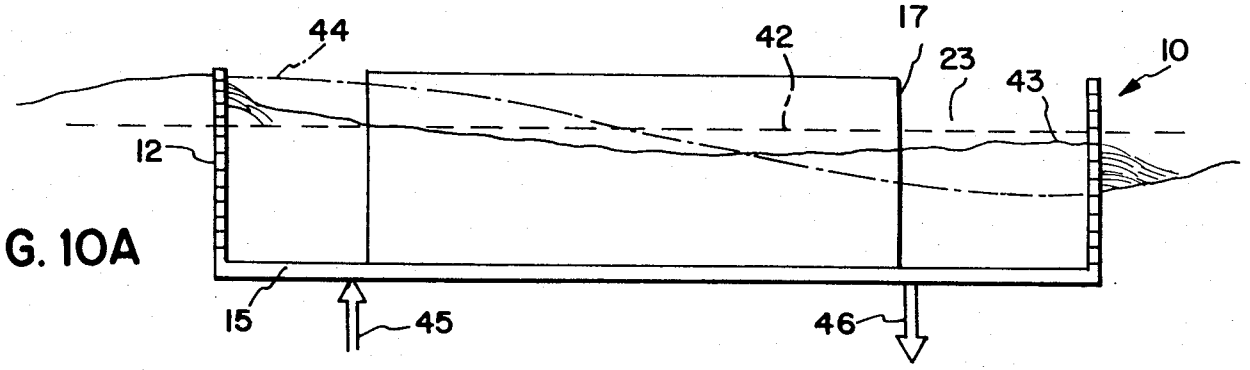
Figure 11:
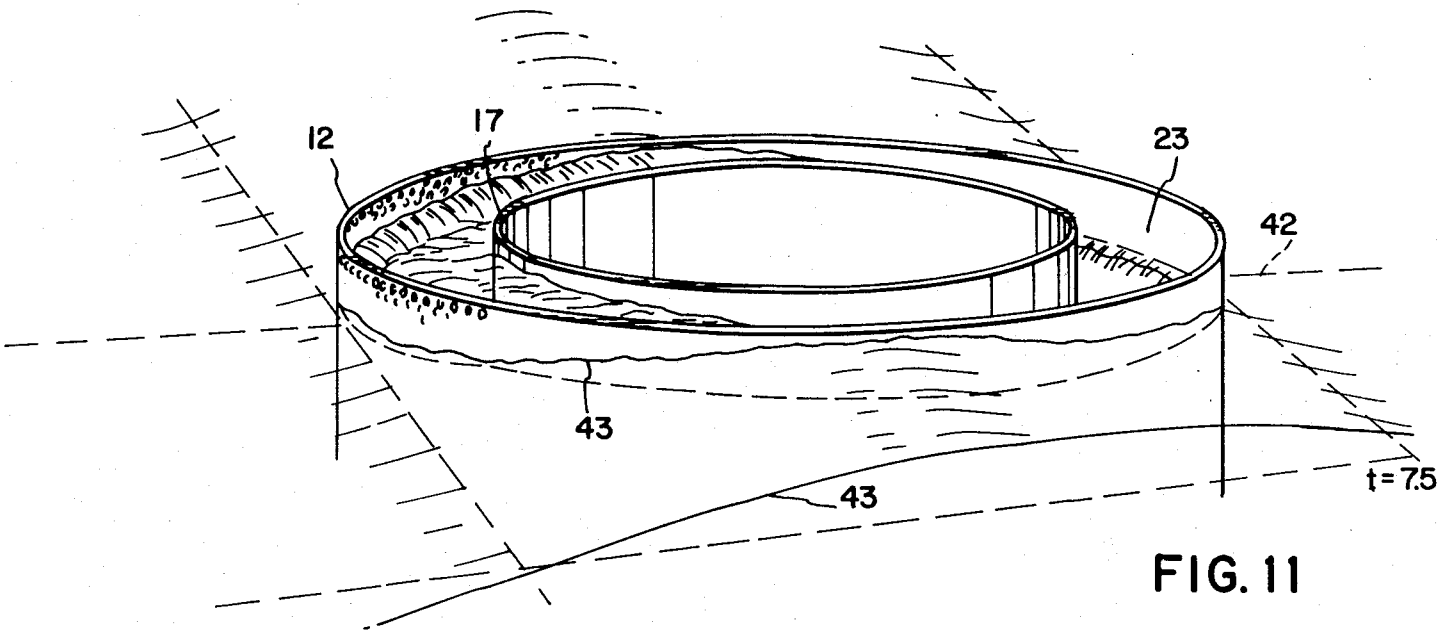
Figure 11A:
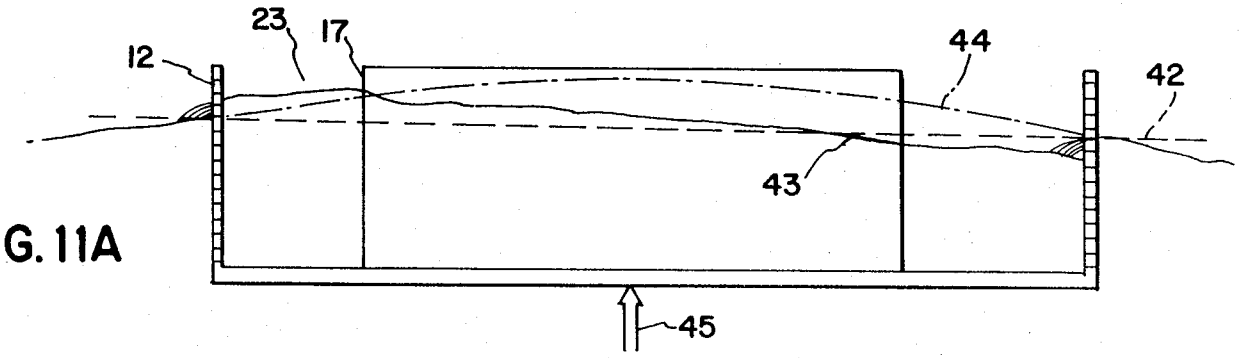
Figure 12:
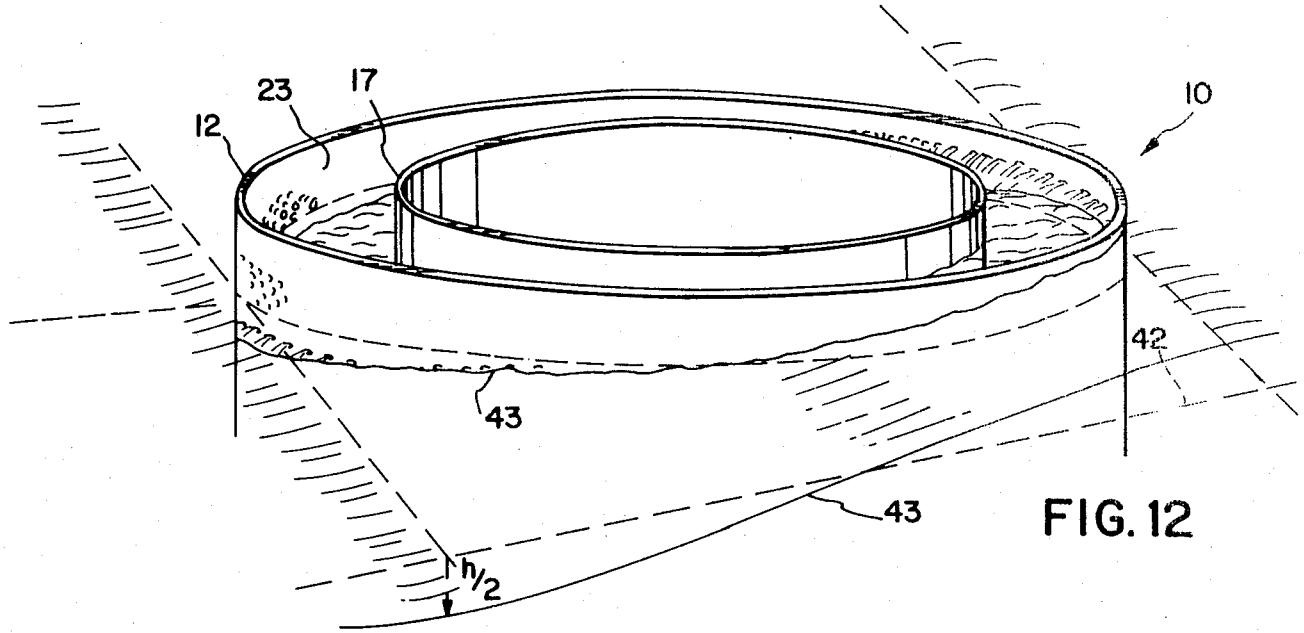
Figure 12A:
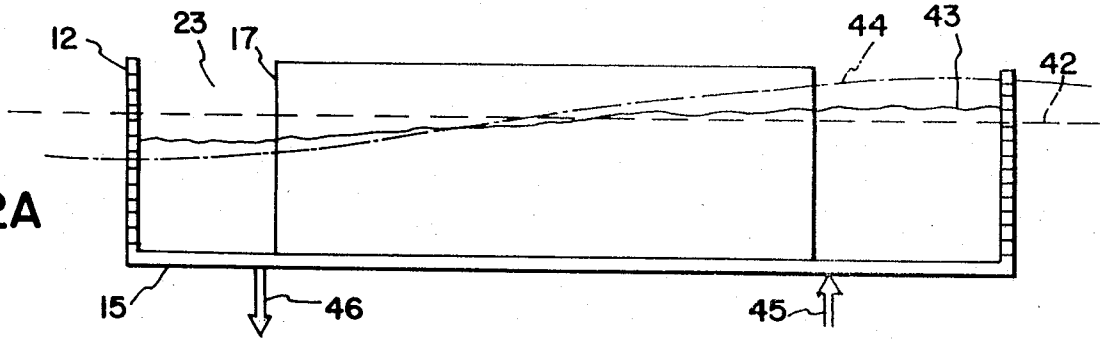

FIG. 15 shows that a structure mass inevitably is far greater when it is a concrete monolithic body, the curve 60 relating mass versus diameter indicating that in sizes below about 160 meters diameter the lesser load-carrying capacity will restrict the use applications, although these lesser sizes have excellent stability and may serve in other applications. The operating displacement, curve 61, is comparable to that for a steel body of the same size, and the confined water mass—curve 62—bears the same ratio to displacement as in FIG. 13. Because the tethering load may be assumed to increase with displacement as shown in curve 63, the supportable load shown by curve 64 is less than for an equivalent steel structure, so that at a nominal draft of 33 meters a diameter of 187 meters would be required to carry 80,000 tonnes. Other bodies of diameter/draft ratio smaller than those exemplified by the graph may however provide greatly increased load-support capabilities.

I claim:

1. A stable floatable marine structure having a diameter between 135 and 215 meters and a diameter to draft ratio between about 3.5 and 6, comprising:

(a) a primary buoyancy tank having an upwardly extending tank wall of substantially right circular cylindrical form and extending above the highest water level, (b) a substantially planar base disc coaxial with and position below and closing the lower end of said tank, said disc having a diameter greater than the diameter of said tank wall and including an imperforate outer marginal portion extending substantially radially outwardly from the junction of said base disc with said tank wall, (c) a shell wall extending upwardly from said outer marginal portion of said base disc substantially coextensive with said tank wall and spaced substantially therefrom to form a generally annular partial confinement chamber bounded by said shell wall, said tank wall, and said base disc, the spacing between said shell wall and said tank wall being such that the radial dimension or width of said chamber is at least 24% of the diameter of said shell, (d) a multiplicity of radially extending tubes mounted in and regularly spaced over the upwardly extending area of the shell wall, said tubes forming passages opening at their outward ends to the sea and opening at their inward ends toward said confinement chamber and having an aggregate cross-sectional area comprising from 26% to 35% of the elevational area of said shell wall, and wherein (e) the confinement chamber is so dimensioned that when the structure is floating at sea, the partly confined water mass in said chamber and said tubes is 80% to 125% of the displacement of said structure, and (f) a working deck rigidly secured to the top of the structure.

2. A marine structure as set forth in claim 1, wherein said primary buoyancy tank has an overall height of 30 to 50 meters and a ratio of overall axial height to overall diameter in the range from about 1:3 to about 1:6.

3. A marine structure as set forth in claim 2, wherein said structure is fabricated predominantly of steel, and wherein said upwardly extending tank wall is spaced radially about 25 to 40 meters from said shell wall.

4. A marine structure as set forth in claim 1, wherein said structure is fabricated predominantly of prestressed reinforced concrete and has an overall height of about 30 to 50 meters, and said base disc diameter is between about 120 meters and 160 meters.

5. A marine structure as set forth in claim 1, wherein said tank wall is spaced radially from about 25 to 35 meters from said shell wall, and wherein said confinement chamber partly confines a volume of seawater of the order of about 70 to 100 cubic meters per square meter of cross-sectional area of said tubular passages.

6. A marine structure as set forth in claim 5, wherein the ratio of said partly confined volume of said chamber to the cross-sectional area of passages occupied by seawater is about 80 cubic meters per square meter.

7. A marine structure as set forth in claim 1, wherein said shell wall is connected with said marginal portion of said base disc and with said tank wall by a series of radially-extending bracing frameworks of substantially planar form, said frameworks being spaced equiangularly and comprising a gridwork of frame members comprising a first set of members that are disposed parallel with each other in spaced-apart relation and inclined at an angle of about 45 degrees to the vertical, and a second set of members that are inclined at about a right angle to members of said first set, members of said sets intersecting each other to form a grid characterized by an aperturing ratio of about 50% and apertures of substantially square cross-section, said members being integrally bonded at their junctions.

8. A marine structure as set forth in claim 1, wherein the underside of said base disc is provided with a series of angularly spaced-apart connectors spaced linearly from the axis of said tank a radial distance not substantially greater than the radius of said tank, said connectors being adapted for attachment of tethering chains or cables, said base disc comprising an upper and a lower cover disc, a series of concentric bracing rings, and a series of angularly spaced radial walls intersecting said rings and boned integrally therewith and with said cover discs.

9. A marine structure as set forth in claim 1, wherein said primary buoyancy tank includes a tube rising from said base disc to a height above the sea, and said base disc is apertured for access from the structure to the sea below said base disc through said tube.

10. A marine structure as set forth in claim 1, wherein said tank has a height of 35 to 45 meters and a ratio of overall height to diameter in the range of 1:3 to 1:6; the spacing between said shell wall and said tank wall is in the range of 25 to 35 meters; the structure has an operating draft of 30–35 meters and a freeboard of 7–15 meters; said confinement chamber partly confines a volume of seawater in the range of 250,000 to 550,000 cubic meters, and the ratio of seawater volume to passage area in said shell wall is in the range of 70 to 100 cubic meters per square meter.

11. The marine structure as set forth in claim 1, wherein the ratio of the diameter of the buoyancy tank to the draft of the structure is approximately 3.0 to 3.5, and wherein the ratio of the diameter of said shell wall to the draft of the structure is approximately 5.0 to 6.0.

12. A floatable marine structure for carrying large loads, comprising:

(a) an outer shell wall of generally cylindrical form and having a diameter from about four to six times the operating draft of the structure, said shell wall being substantially perforated throughout its cross-sectional area, said perforated area comprising an aggregate 26% to 35% of the total cross-sectional area of said shell wall, (b) a buoyancy tank having a cylindrical wall spaced substantially inwardly from said shell wall;

(c) an imperforate base disc extending below said shell wall and said wall of said tank for interconnecting the same in spaced relation, (d) an annular chamber defined by said disc and said walls for receiving and partly conforming a volume of seawater admitted thereto through the perforations in said outer shell, the radial dimension or width of said chamber being at least 24% of the diameter of said outer shell, and wherein (e) said volume of seawater in said annular chamber is in the range from 80% to 125% of the displacement of the structure, and (f) a working deck rigidly secured to the top of the structure.

13. A marine structure adapted to float in the sea and suitable for carrying very large loads, comprising:

an extensively perforated, upwardly extending outer shell wall of substantially cylindric form, said perforations comprising 26% to 35% of the elevational area of said shell wall;

a buoyancy tank having a substantially cylindric wall spaced inwardly of said shell wall, the width or diameter of said tank being greater than its height;

an annular chamber defined between said walls, said chamber having a radial dimension or width of at least 24% of the diameter of said outer shell;

a disc base having an outer portion thereof connecting the lower ends of said shell wall and of said tank wall, said outer portion of said base being imperforate, wherein:

said annular chamber is dimensioned to partly confine a mass of seawater equal to at least two thirds of the displacement of the structure and is adapted to peripherally receive and temporarily retain injected water mass during the cresting phase of a wave so that downwardly-acting pressure substantially matches in time and over a specific bottom area the heaving force under the base, while also peripherally discharging water mass during the troughing phase of the wave to compensate for reduced pressures under the base; and a working deck rigidly secured to the top of the structure.

14. A marine structure as claimed in claim 13, wherein the overall width of the tank is greater than its height.

15. A stable floatable marine structure adapted to float in the sea, comprising:

a primary buoyancy tank having an upwardly extending tank wall of substantially cylindrical form, a substantially planar disc base coaxial with and closing a lower end of said tank, and having a width or diameter greater than the width or diameter of said tank wall, an outer marginal portion of said disc base extending from the junction of said base with said tank wall and being unapertured; a peripheral shell wall extending upwardly from said outer marginal portion of said base substantially coextensive with said tank wall and spaced from said tank to define therebetween a confinement chamber having a radial dimension or width of at least 24% of the diameter of said shell, said shell wall being extensively perforated by a large multiplicity of tubular passages regularly spaced over the upwardly extending area of the shell wall and opening at their outward ends to the sea and opening at their inward ends toward said tank wall, said tubular passages comprising 26% to 35% of the upwardly extending area of said shell wall; said structure being capable of partly confining a mass of sea water equal to at least two thirds of the displacement of said structure; and a working deck rigidly secured to the top of the structure.

16. A marine structure according to cl aim 15 wherein said buoyancy tank has about the same height as the shell wall.

17. A marine structure according to claim 15 wherein said base is hollow for ballasting and is less than 5 meters thick.

18. A marine structure according to claim 15 wherein said base comprises an upper cover disc and a lower cover disc, a series of concentric bracing rings supporting said disc, and a series of angularly spaced radial walls intersecting said rings and bonded integrally therewith and with said cover discs.

19. A marine structure according to claim 15 wherein the underside of said base is provided with a series of angularly spaced-apart connectors spaced linearly from the axis of said tank a radial distance not substantially greater than the radius of said tank, said connectors being adapted for attachment of tethering chains or cables.

20. A marine structure according to claim 15, wherein (a) said tank has a ratio of overall height to overall width or diameter in the range of about 1:3 to 1:6, and a height within the range of about 30 to 50 meters, preferably 35 to 45 meters;

(b) said base has an overall width or diameter of within the range of 135–210 meters, preferably about 172 meters;

(c) the spacing between said shell wall and tank wall is within the range of about 25 to 40 meters;

(d) said shell wall has an overall height of about 30 to 50 meters, an operating draft of about 30 to 35 metes, or a freeboard of about 7 to 15 meters; and further including (e) a chamber capable of partly confining seawater having a volume to total cross sectional area of passages or perforations in said shell wall within the range of about 70 to 100 cubic meters per square meter, and capable of confining a mass of seawater in the range of 80% to 125% of displacement.

21. A marine structure according to claim 15 wherein said structure is predominantly fabricated of steel and said outer wall is perforated with transverse open-ended tubes of length about 1.5 meters and cross-sectional area from about 0.9 $m^2$ to about 1.2 $m^2$.

22. A marine structure according to claim 15 wherein said outer wall, said disc-form base and said cylindrical wall of said tank are connected by substantially planar radial frameworks, which are spaced equiangularly and comprise a gridwork of frame members comprising a first set of members which are disposed parallel with each other in spaced-apart relation and inclined at an angle of about 45 degrees to the vertical, and a second set of members of said first set, members, of said sets intersecting each other to form a grid characterized by an aperturing ratio of about 50% and apertures of substantially square or rectangular cross-section, said members being integrally bonded at their junctions.

* * * * *